US005395026A

United States Patent [19]

Yu

[11] Patent Number: 5,395,026

[45] Date of Patent: Mar. 7, 1995

[54] TILE CUTTING PLIERS

[76] Inventor: Chin-Yung Yu, No. 5, Cheng-Te 3rd Rd., Shu-I Li, S. Dist. Taichung, Taiwan, Prov. of China

[21] Appl. No.: 160,183

[22] Filed: Dec. 2, 1993

[51] Int. Cl.[6] ..... B26F 3/00; B25B 7/22

[52] U.S. Cl. ..... 225/96.5; 7/133; 81/424

[58] Field of Search ..... 225/93, 94, 95, 96, 225/96.5; 7/125, 132, 133; 81/422, 424

[56] References Cited

FOREIGN PATENT DOCUMENTS 473418 1/1915 France ..... 7/132

718985 11/1966 Italy ..... 225/93

*Primary Examiner*—Richard K. Seidel

*Assistant Examiner*—Raymond D. Woods

*Attorney, Agent, or Firm*—Bacon & Thomas

[57] ABSTRACT

A tile cutting pliers including two horizontal cutting plates on two pivoted blades at one end and acted against each other to trim tiles, a first mounting frame and a second mounting frame respectively raised from either cutting plate, a circular cutter fastened to the first mounting frame at an outer side for cutting a scratch on tiles, and a jaw plate turned about a pivot on the second mounting frame, the jaw plate having a recessed portion on a front chucking face thereof transversely disposed in the middle, and wherein the jaw plate is turned inwards and moved to act against the first upright mounting frame to clamp a tile being placed therebetween or turned outwards from the first mounting frame for permitting the cutting plates to be acted against each other to cut a tile.

1 Claim, 5 Drawing Sheets

TILE CUTTING PLIERS

BACKGROUND OF THE INVENTION

The present invention relates to pliers, and relates more particularly to a pliers for trimming and cutting tiles.

In building construction, ceramic tiles are most widely used to cover the wall for decoration because they are easy to wash and durable in use and have assorted colors and patterns. However, a tile may have to be cut properly when it is to be covered on a corner area. FIG. 1 shows a pliers used for cutting tiles. This structure of pliers is applicable for trimming the edge of a tile only, however, it is not suitable for separating a tile into two pieces across the length or width thereof. FIG. 2 shows another structure of pliers which can be used to cut a scratch on the tile to be cut, and then to clamp the tile along the scratch causing it to break. However, this structure of pliers is not suitable for trimming the edge of a tile. Therefore, the aforesaid two pliers must be separately prepared for different purposes. It is not economic to prepare two different tools for cutting a tile. Furthermore, it is not convenient to carry two different tools together.

SUMMARY OF THE INVENTION

The present invention has been accomplished under the aforesaid circumstances. It is therefore an object of the present invention to provide a tile cutting pliers which is practical for trimming tiles as well as for cutting tiles. It is another object of the present invention to provide a tile cutting pliers which greatly saves the tile cutting tool cost. To achieve this object, there is provided a tile cutting tools comprising a circular cutter for cutting a scratch on tiles, a cutter unit acted to trim tiles, and a clamping unit acted to clamp a tile causing it to break along the scratch been cut thereon. The clamping unit can be turned outwards so as not to hinder the operation of the cutter unit.

DETAILED DESCRIPTION OF THE PREFERRED EMBODIMENT

Figure 1:
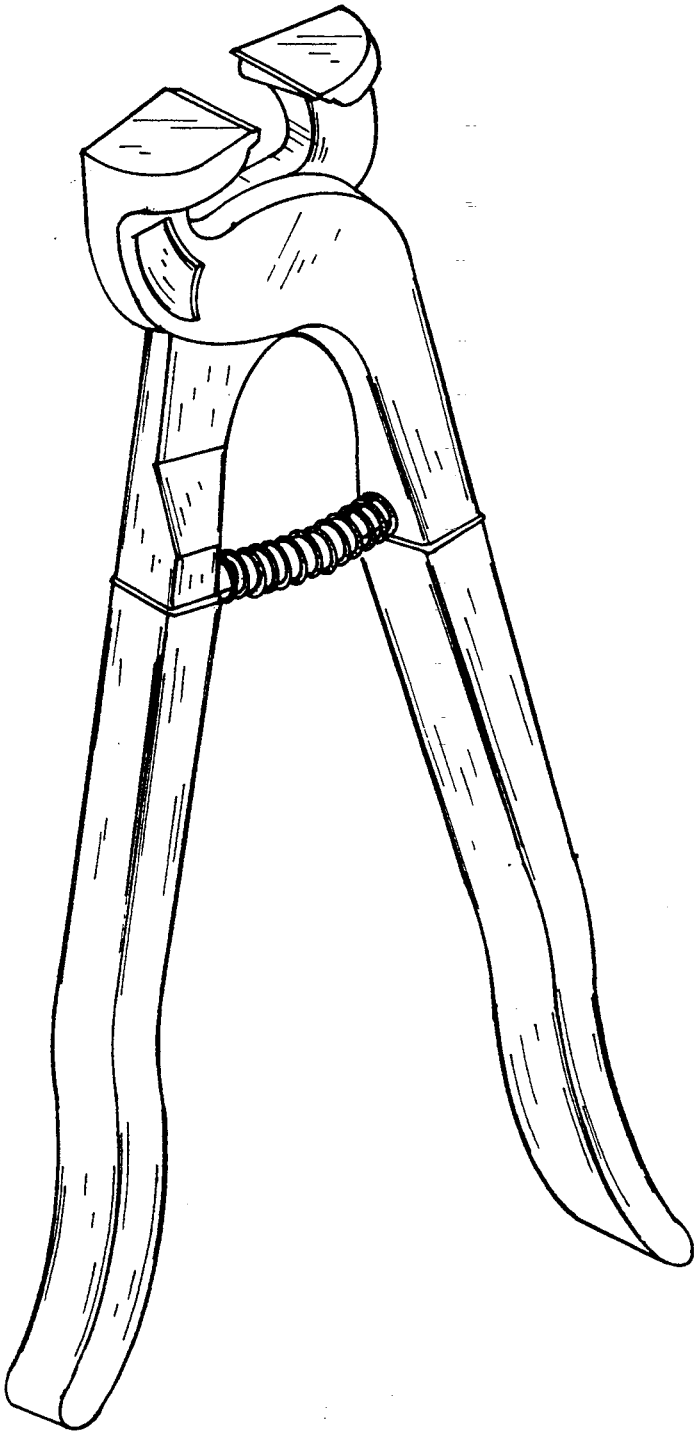
Fig.1 PRIOR ART
FIG. 1 shows a structure of tile cutting pliers according to the prior art.
Figure 2:
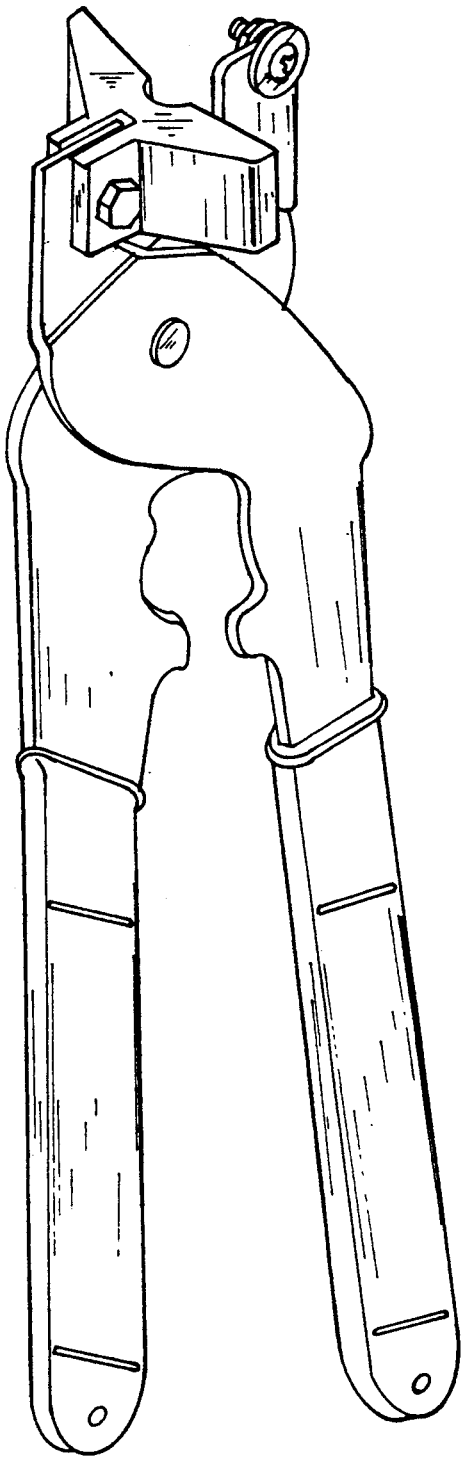
Fig.2 PRIOR ART
FIG. 2 shows another structure of tile cutting pliers according to the prior art.
Figure 3:
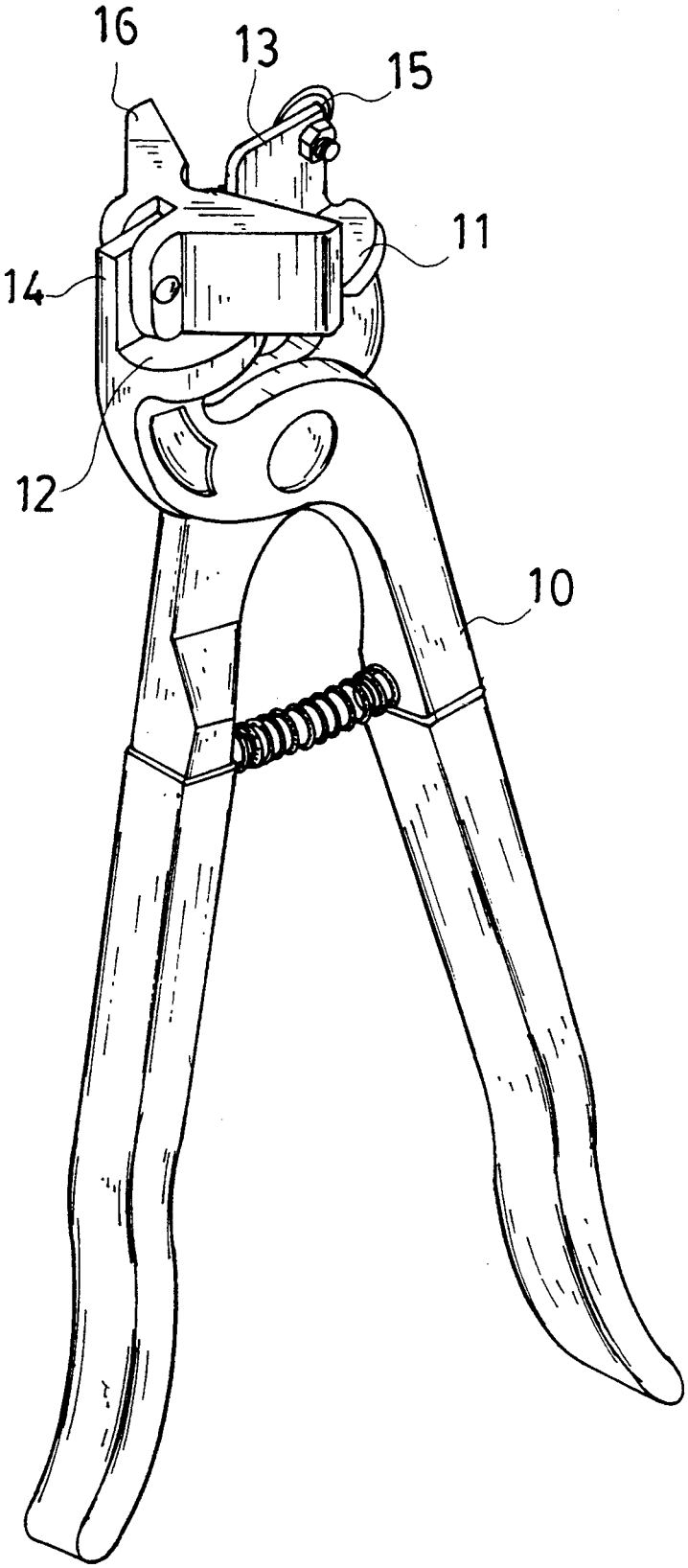
FIG. 3 is an elevational view of a tile cutting pliers according to the preferred embodiment of the present invention.
Figure 4:
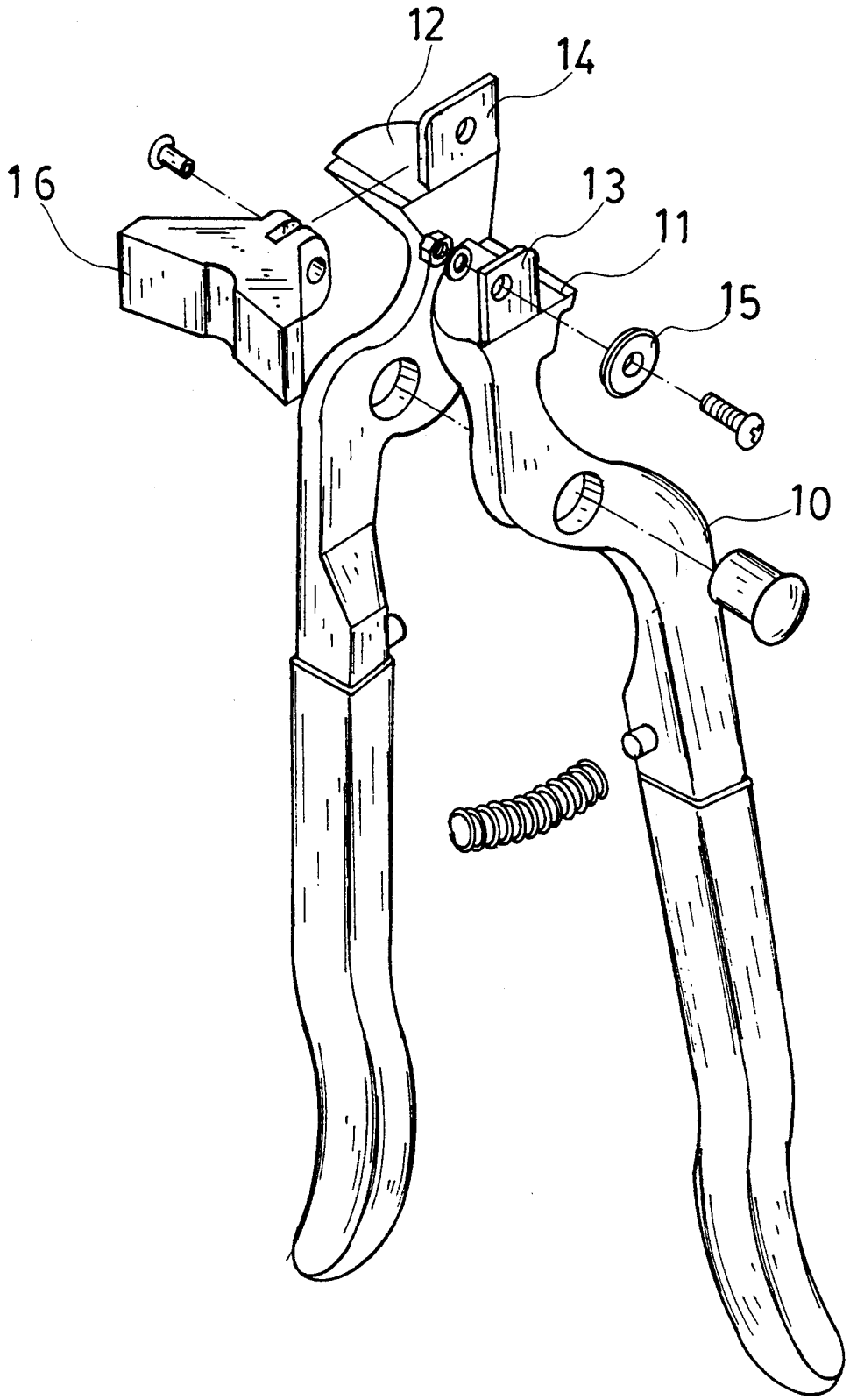
FIG. 4 is an exploded view of the tile cutting pliers shown in FIG. 3.

Referring to FIGS. 3 and 4, a pliers in accordance with the preferred embodiment of the present invention is generally comprised of two blades 10 pivoted in the middle and terminated to a respective horizontal cutting plate 11;13. The horizontal cutting plate 11 or 13 of either blade 10 comprises an upright mounting frame 13 or 14. A circular cutter 15 and a jaw plate 16 respectively fastened to the horizontal cutting plates 11;13 of the blades 10. The jaw plate 16 is pivoted about a pivot on the respective upright mounting frame 14, and therefore it can be turned inward and then moved against the mounting frame 13 to clamp the tile to be cut (see FIG. 6), or turned outward so as not to hinder the operation of the cutting plates 11;12 (see FIG. 5). Furthermore, the jaw plate 16 has a recessed middle portion fitting the mounting frame 13.

Figure 5:
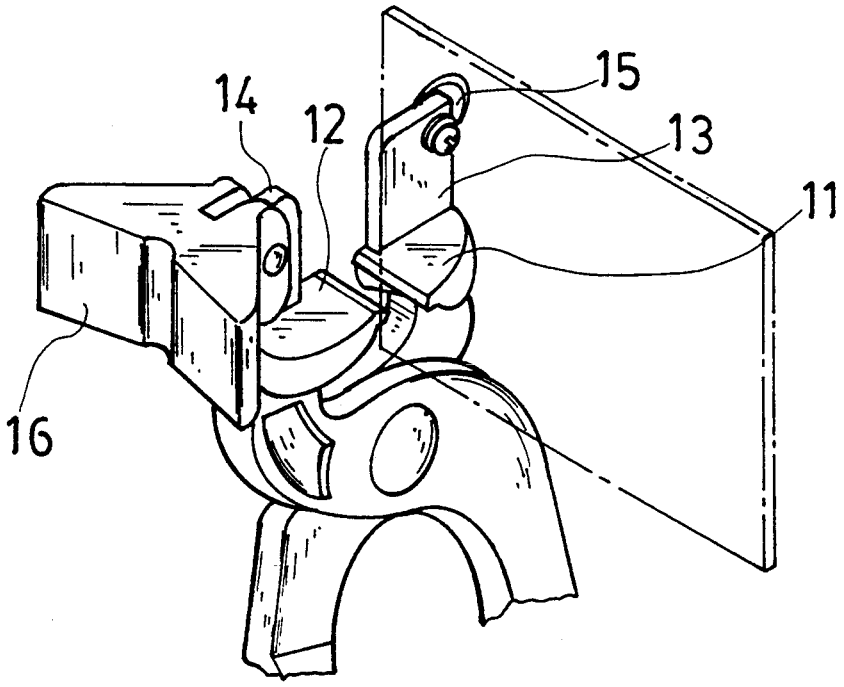
FIG. 5 shows the tile cutting pliers of FIG. 3 operated to trim a tile.

Referring to FIG. 5, the jaw plate 16 is turned outwards, and the horizontal cutting plates 11;12 are acted against each other to trim a tile. Therefore, a tile can be conveniently cut bit by bit according to the desired pattern.

Figure 6:
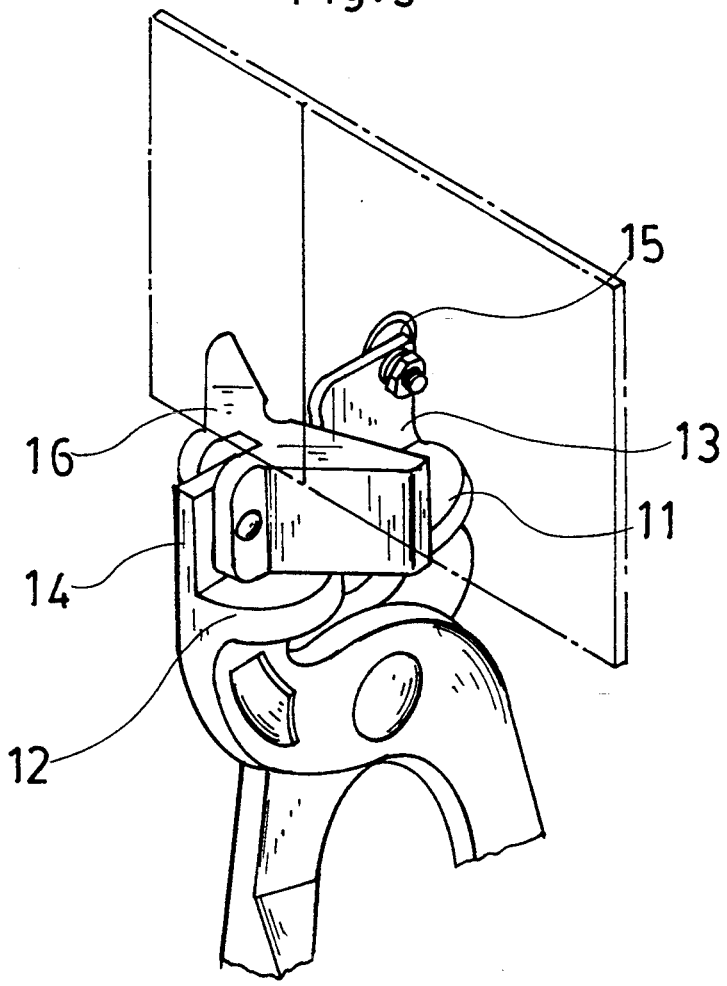
FIG. 6 shows the tile cutting pliers of FIG. 3 operated to clamp a tile.

The pliers can also be operated to cut a tile into two pieces across the length or width of the tile by: using the circular cutter 15 to cut a scratch on the tile across the width or length thereof, then turning the jaw plate 16 inwards and then putting the tile between the jaw plate 16 and the mounting frame 13 permitting the scratch to be aligned with the recessed portion on the jaw plate 16, and then operating the blades 10 to move the jaw plate 16 and the mounting frame 13 toward each other (see FIG. 6). When the jaw plate 16 and the mounting frame 13 are acted against the tile at two opposite sides, the tile is immediately broken into two pieces along the scratch.

As indicated, the present invention provides a tile cutting pliers which is suitable for trimming tiles according to desired patterns, as well as cutting tiles across the length or width thereof.

It will be understood that various modifications and changes could be made to the aforedescribed embodiment without departing from the spirit and scope of the invention. Accordingly, the aforedescribed embodiment is intended for purpose of illustration and not as limitation.

I claim:

1. Tile cutting pliers comprising:

a) a pair of elements pivotally attached together, the elements forming a pair of handles on one side of the pivot attachment and a pair of jaws on an opposite side of the pivot attachment;

b) a cutting plate formed on each jaw such that the cutting plates will cut a tile interposed between the cutting plates when the cutting plates are moved toward each other;

c) a mounting frame extending from each cutting plate;

d) a circular cutter rotatably attached to one mounting frame; and e) a jaw plate pivotally attached to the other mounting frame, the jaw plate having a recessed middle portion and movable between a first position wherein the recessed middle portion faces toward the one mounting frame and a second position wherein the recessed middle portion faces away from the one mounting frame.

* * * * *